US008670010B2

(12) United States Patent
Kano

(10) Patent No.: US 8,670,010 B2
(45) Date of Patent: Mar. 11, 2014

(54) METHOD FOR CONTROLLING PRINTING SPEED OF THERMAL HEAD

(71) Applicant: Brother Kogyo Kabushiki Kaisha, Nagoya (JP)

(72) Inventor: Yasutoshi Kano, Kariya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/798,765

(22) Filed: Mar. 13, 2013

(65) Prior Publication Data

US 2013/0194371 A1 Aug. 1, 2013

Related U.S. Application Data

(63) Continuation-in-part of application No. PCT/JP2012/056992, filed on Mar. 19, 2012.

(30) Foreign Application Priority Data

Mar. 30, 2011 (JP) ..... 2011-075684

(51) Int. Cl.
*B41J 2/325* (2006.01)

(52) U.S. Cl.
USPC ..... 347/171; 347/180

(58) Field of Classification Search
USPC ..... 347/171, 180, 182, 188, 194, 195
See application file for complete search history.

(56) References Cited

U.S. PATENT DOCUMENTS

| | | | | |
|---|---|---|---|---|
| 7,034,855 | B2 * | 4/2006 | Muto et al. | 347/180 |
| 2005/0219345 | A1 | 10/2005 | Muto et al. | |
| 2005/0264593 | A1 * | 12/2005 | Nagamura et al. | 347/5 |

FOREIGN PATENT DOCUMENTS

| | | |
|---|---|---|
| JP | 5050638 | 3/1993 |
| JP | 5084933 | 4/1993 |
| JP | 8258313 | 10/1996 |
| JP | 2000168111 | 6/2000 |
| JP | 2001180027 | 7/2001 |
| JP | 3934375 | 6/2007 |
| JP | 2009113445 | 5/2009 |
| JP | 4337509 | 9/2009 |
| JP | 4572558 | 11/2010 |

OTHER PUBLICATIONS

Japanese International Search Report for PCT/JP2012/056992.

International Preliminary Report on Patentability issued in PCT/JP2012/056992 on Oct. 17, 2013.

* cited by examiner

*Primary Examiner* — Huan Tran

(74) *Attorney, Agent, or Firm* — McCarter & English, LLP

(57) ABSTRACT

A method for controlling a printing speed of a thermal head having a plurality of heater elements arranged in a line includes: dividing a set of printing data into blocks each comprising one or more printing lines aligned in a main scanning direction, in which the dividing is in a sub scanning direction, and in which a block including a first predetermined number of printing lines is regarded as a unit block; calculating the number of the heater elements to be driven for each of printing lines included in a block as the number of on-dots, and comparing the numbers of on-dots for the block to obtain a maximum number of on-dots for the block; and setting a printing speed for one block to be slower than a printing speed for another block with smaller maximum number of on-dots than maximum number of on-dots for the one block.

5 Claims, 10 Drawing Sheets

FIG. 3A

PRINTING SPEED DETERMINATION TABLE FOR BATTERY OPERATION (UNIT: mm/sec)

| WITHIN BLOCK | TMP. RANK | | | | | | | | | | |
|---|---|---|---|---|---|---|---|---|---|---|---|
| MAX. NO. OF ON-DOTS (PER LINE) | 1 | 2 | 3 | 4 | 5 | 6 | 7 | 8 | 9 | 10 | 11 |
| 128~113 | 15 | 15 | 15 | 15 | 15 | 15 | 20 | 20 | 30 | 30 | 30 |
| 112~97 | 15 | 15 | 15 | 20 | 20 | 20 | 20 | 30 | 30 | 30 | 30 |
| 96~81 | 20 | 20 | 20 | 20 | 20 | 20 | 30 | 30 | 30 | 30 | 30 |
| 80~65 | 20 | 20 | 20 | 30 | 30 | 30 | 30 | 30 | 30 | 30 | 30 |
| 64 OR UNDER | 30 | 30 | 30 | 30 | 30 | 30 | 30 | 30 | 30 | 30 | 30 |

FIG. 3B

TMP. RANK DETERMINATION TABLE

| TMP. RANK | 1 | 2 | 3 | 4 | 5 | 6 | 7 | 8 | 9 | 10 | 11 |
|---|---|---|---|---|---|---|---|---|---|---|---|
| TMP. DETECTED BY THERMISTOR | 5~ 9°C | 10~ 14°C | 15~ 19°C | 20~ 24°C | 25~ 29°C | 30~ 34°C | 35~ 39°C | 40~ 44°C | 45~ 49°C | 50~ 54°C | 55°C OR HIGHER |

METHOD FOR CONTROLLING PRINTING SPEED OF THERMAL HEAD

CROSS REFERENCE TO RELATED APPLICATIONS

The present application is a continuation-in-part of international patent application No. PCT/JP2012/056992, filed on Mar. 19, 2012, which claims priority from Japanese Patent Application No. 2011-075684, filed on Mar. 30, 2011, the disclosure of which is incorporated herein by reference in its entirety.

TECHNICAL FIELD

The disclosure relates to a method for controlling a printing speed of a thermal head having a plurality of heater elements arranged in line.

BACKGROUND

There has conventionally been proposed a technique for enabling high speed printing without increasing current capacity of an adaptor of a thermal head. For instance, in a conventional printer control method, when printing an image, pixel values each corresponding to one line along the main scanning direction of the image of a printing object are accumulated to obtain an integrated value of the pixels of the image. If the integrated value exceeds a reference value, the print speed is set slower than a normal speed. As a result, a large amount of application energy can be secured to a thermal head at one line, so that density level printable at a thermal head can be enhanced, while suppressing the power capacity of the power source supplying exothermic energy to the thermal head as low as possible. Further, if the integrated value is below the reference value, the print speed is set in the normal speed, so that the decrease in the print speed can be avoided and the image can be printed effectively. Accordingly, minimizing the volume (downsizing) of a power source and optimizing the print speed can be realized simultaneously.

However, in the conventional printer control method, whether to set the print speed to be the normal speed or to be slower than the normal speed is determined by each line along the main scanning direction of the printing object image. Accordingly, if the setting of the print speed is changed by each one line with regard to the integrated value accumulated by a pixel unit forming the one line, the setting change occurs so frequently that the print quality is adversely affected.

SUMMARY

The disclosure has been made in view of the above-described problems and has an object to provide a method for controlling a printing speed of a thermal head to enable high speed printing without increasing current capacity of an adaptor and without adversely affecting a print quality.

To achieve the purpose of the disclosure, there is provided a method for controlling a printing speed of a thermal head having a plurality of heater elements arranged in a line, comprising: dividing a set of printing data into blocks each comprising one or more printing lines aligned in a main scanning direction parallel to the arranged line of the plurality of heater elements of the thermal head, wherein the dividing is in a sub scanning direction orthogonal to the main scanning direction, and wherein a block including a first predetermined number of printing lines is regarded as a unit block; calculating the number of the heater elements to be driven for each of printing lines included in a block as the number of on-dots, and comparing the numbers of on-dots for the block to obtain a maximum number of on-dots for the block; and setting a printing speed for one block to be slower than a printing speed for another block with smaller maximum number of on-dots than maximum number of on-dots for the one block, so as to variably control a printing speed of the thermal head by each block.

BRIEF DESCRIPTION OF THE DRAWINGS

FIG. 3A is a printing speed determination table for battery operation;

FIG. 3B is a temperature rank determination table;

DETAILED DESCRIPTION

1. Outline of the Disclosure

Figure 1:
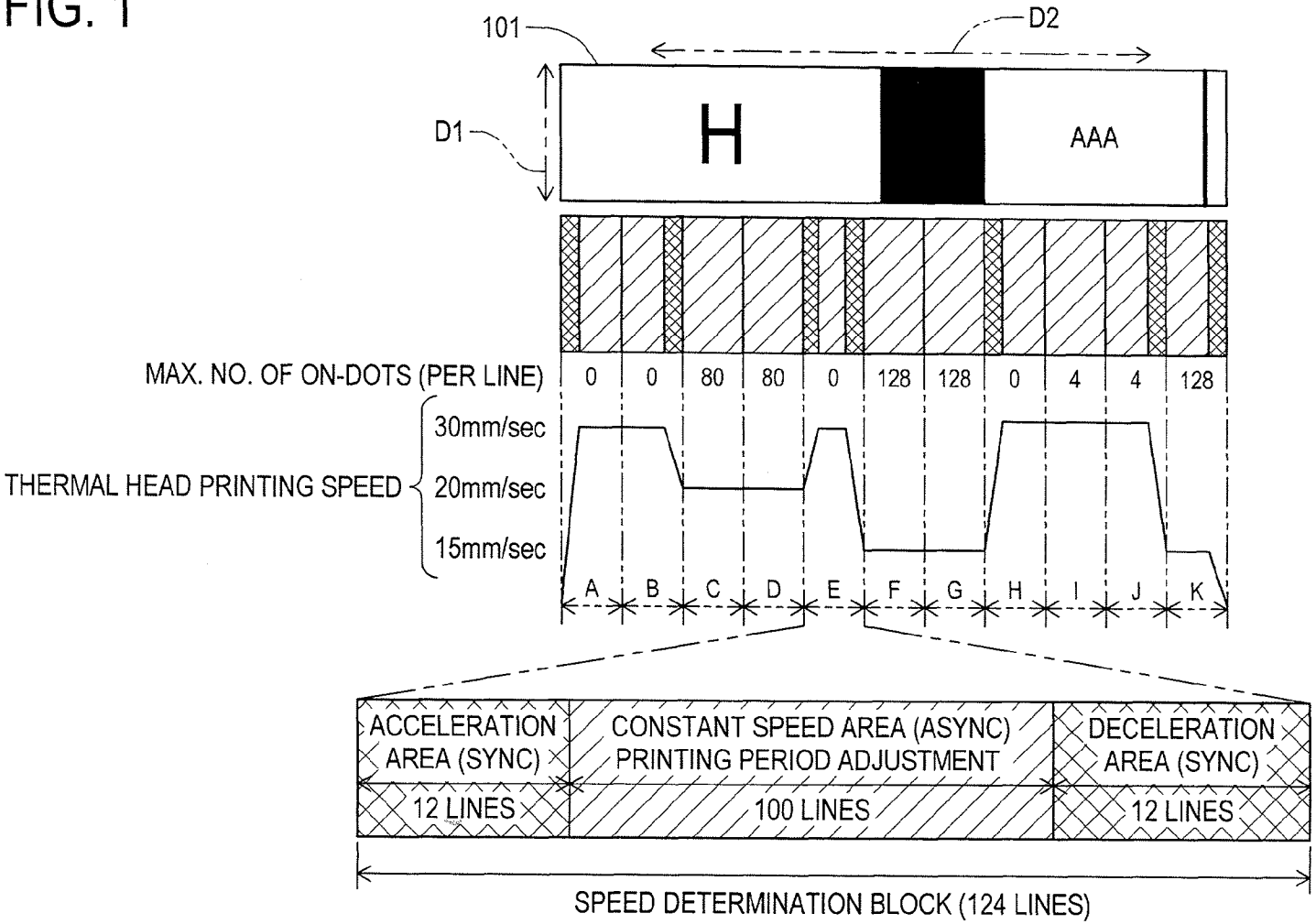
FIG. 1 is a schematic diagram of a method for controlling a printing speed of a thermal head according to the present disclosure.

A detailed description of an exemplary embodiment of a method for controlling a printing speed of a thermal head directed to the disclosure will now be given referring to the accompanying drawings. In the embodiment, the printing speed of the thermal head is controlled. Hereinafter, the outline of the control is discussed referring to FIG. 1. In FIG. 1, print contents on a long printing medium 101 represent print data to be printed by the thermal head. The arrangement direction of a plurality of heater elements provided for the thermal head is defined as a main scanning direction D1, and the direction orthogonal to the main scanning direction D1 is defined as a sub scanning direction D2. However, the thermal head and the plurality of heater elements are not shown in FIG. 1.

In the embodiment, the printing speed of the thermal head is controlled in the following steps (1) through (4).

(1) A set of printing data whose print contents are as represented on the printing medium 101 is divided into speed determination blocks A through K. Each of the speed determination blocks A through K may be configured with "a first predetermined number" of printing lines aligned in the sub scanning direction D2 in succession. The printing line represents one line's worth of printing data arranged in a line in the main scanning direction D1, and also the amount of data to be printed in a single printing period, using the heater elements aligned in the main scanning direction D1 of the thermal head.

In the embodiment of FIG. 1, "the first predetermined number" is set as "124", and there are 128 heater elements provided. Further, the speed determination block K in the end of the set of printing data may be an "odd block" containing less than 124 printing lines. However, "the first predetermined number" or the number of heater elements is not limited to the above concrete figure. Hereinafter, "line" corresponds to a printing line, and "dot" corresponds to a heater element.

(2) With regard to a speed determination block A which comes the first in the set of printing data, the total number of heater elements to be driven (dots/line) is calculated, by each printing line of the 124 printing lines composing the speed determination block A. The maximum number of the total numbers is obtained as the maximum number of on-dots for the speed determination block A. In the embodiment of FIG. 1, no heater elements are driven for the speed determination block A, therefore "0" is obtained as the maximum number of on-dots for the speed determination block A.

(3) According to the obtained maximum number of on-dots and the temperature in the vicinity of the thermal head, the printing speed of the thermal head is determined with regard to the speed determination block A. There, the printing speed of the thermal head is determined such that, the smaller the maximum number of on-dots is, the faster the printing speed is set, and also the higher the temperature in the vicinity of the thermal head is, the faster the printing speed is set.

In the embodiment of FIG. 1, the printing speed of the thermal head is selected from among three speeds (30 mm/sec, 20 mm/sec, 15 mm/sec), and the printing speed of the thermal head in the speed determination block A is determined to be 30 mm/sec. The piece of printing data corresponding to the speed determination block A is printed onto the printing medium 101 at the printing speed of the thermal head thus determined.

Incidentally, in the above step (3), the printing speed of the thermal head may be determined considering only one of the two conditions that the smaller the maximum number of on-dots is, the faster the printing speed is set, and that also the higher the temperature in the vicinity of the thermal head is, the faster the printing speed is set.

(4) The above steps (2) to (3) are executed by each of the speed determination blocks B through K. As a result, in the embodiment of FIG. 1, the maximum number of on-dots for the speed determination blocks A through K are calculated as: 0 dot/line, 0 dot/line, 80 dots/line, 80 dots/line, 0 dot/line, 128 dots/line, 128 dots/line, 0 dot/line, 4 dots/line, 4 dots/line, and 128 dots/line, respectively. The printing speeds at the speed determination blocks A through K are determined to be: 30 mm/sec, 30 mm/sec, 20 mm/sec, 20 mm/sec, 30 mm/sec, 15 mm/sec, 15 mm/sec, 30 mm/sec, 30 mm/sec, 30 mm/sec, and 15 mm/sec, respectively. The pieces of printing data corresponding to the speed determination blocks A through K are sequentially printed on the printing medium 101 at the printing speeds determined, respectively.

If the printing speeds of the thermal head in two consecutive speed determination blocks in the speed determination blocks A through K are different from each other, an acceleration area or a deceleration area is provided in one speed determination block having faster printing speed, at the beginning thereof following or the end thereof followed by the other speed determination block having slower printing speed. In the acceleration area, the printing speed of the thermal head is accelerated. In the deceleration area, the printing speed of the thermal head is decelerated.

In the embodiment of FIG. 1, the printing speeds of the thermal head in two consecutive speed determination blocks D, E are different as 20 mm/sec and 30 mm/sec, respectively. The printing speed 30 mm/sec of the speed determination block E is faster than the printing speed 20 mm/sec of the speed determination block D, so that, in the beginning of the speed determination block E following the speed determination block D, an acceleration area is provided in which the printing speed of the thermal head accelerates from 20 mm/sec to 30 mm/sec. Further, the printing speeds of the thermal head in two consecutive speed determination blocks E, F are different as 30 mm/sec and 15 mm/sec, respectively. The printing speed 15 mm/sec of the speed determination block F is slower than the printing speed 30 mm/sec of the speed determination block E, so that, in the end of the speed determination block E followed by the speed determination block F, a deceleration area is provided in which the printing speed of the thermal head decelerates from 30 mm/sec to 15 mm/sec.

In a similar manner, the printing speeds of the thermal head in two consecutive speed determination blocks B, C are different as 30 mm/sec and 20 mm/sec. The printing speed 20 mm/sec of the speed determination block C is slower than the printing speed 30 mm/sec of the speed determination block B, so that, in the end of the speed determination block B followed by the speed determination block C, a deceleration area is provided in which the printing speed of the thermal head decelerates from 30 mm/sec to 20 mm/sec. Further, the printing speeds of the thermal head in two consecutive speed determination blocks G, H are different as 15 mm/sec and 30 mm/sec. The printing speed 30 mm/sec of the speed determination block H is faster than the printing speed 15 mm/sec of the speed determination block G, so that, in the beginning of the speed determination block H following the speed determination block G, an acceleration area is provided in which the printing speed of the thermal head accelerates from 15 mm/sec to 30 mm/sec. Further, the printing speeds of the thermal head in two consecutive speed determination blocks J, K are different as 30 mm/sec and 15 mm/sec. The printing speed 15 mm/sec of the speed determination block K is slower than the printing speed 30 mm/sec of the speed determination block J, so that, in the end of the speed determination block J followed by the speed determination block K, a deceleration area is provided in which the printing speed of the thermal head decelerates from 30 mm/sec to 15 mm/sec.

Further, an acceleration area is provided in the beginning of the speed determining block A, the first block in the set of printing data, as the printing speed of the thermal head is changed from 0 mm/sec to 30 mm/sec in the beginning of the speed determination block A positioned the first in the set of printing data. Thus, in the beginning of the speed determination block A, the acceleration area is provided in which the printing speed of the thermal head accelerates from 0 mm/sec to 30 mm/sec. Further, a deceleration area is provided in the end of speed determination block K, the last block in the set of printing data, as the printing speed of the thermal head is changed from 15 mm/sec to 0 mm/sec in the end of the speed determination block K positioned the last in the set of printing data. Thus, in the end of the speed determination block K, a deceleration area is provided in which the printing speed of the thermal head decelerates from 15 mm/sec to 0 mm/sec.

In the embodiment of FIG. 1, the acceleration area and the deceleration area are each configured with 12 printing lines. Then, the speed determination block E is provided with an acceleration area containing 12 printing lines in the beginning thereof and a deceleration area containing 12 printing lines in the end thereof. Further, a constant speed area containing 100 printing lines is provided between the acceleration area and the deceleration area. In the constant speed area, the printing speed of the thermal head is maintained constant at a printing speed as determined above.

Similarly, the speed determination block A is configured with the acceleration area of 12 printing lines in the beginning thereof, and a constant speed area of 112 printing lines, following the acceleration area to the end thereof. The speed determination block B is configured with the deceleration area of 12 printing lines at the end thereof, and a constant speed area of 112 printing lines from the start thereof to the deceleration area. The speed determination block H is configured with the acceleration area of 12 printing lines in the beginning thereof and a constant speed area of 112 printing lines following the acceleration area to the end thereof. The speed determination block J is configured with the deceleration area of 12 printing line at the end thereof, and a constant speed area of 112 printing line from the start thereof to the deceleration area. The speed determination block K is configured with the deceleration area of 12 printing lines at the end thereof and a constant speed area of 112 printing lines from the start thereof up to the deceleration area.

Incidentally, in a case of using a stepping motor as a later-described tape conveying motor 2 (refer to FIG. 7), printing period adjustment is carried out in a constant speed area, neither in an acceleration area nor in a deceleration area, at each of the speed determination blocks A through K.

[2. External Configuration of Tape Printing Apparatus]

Figure 4:
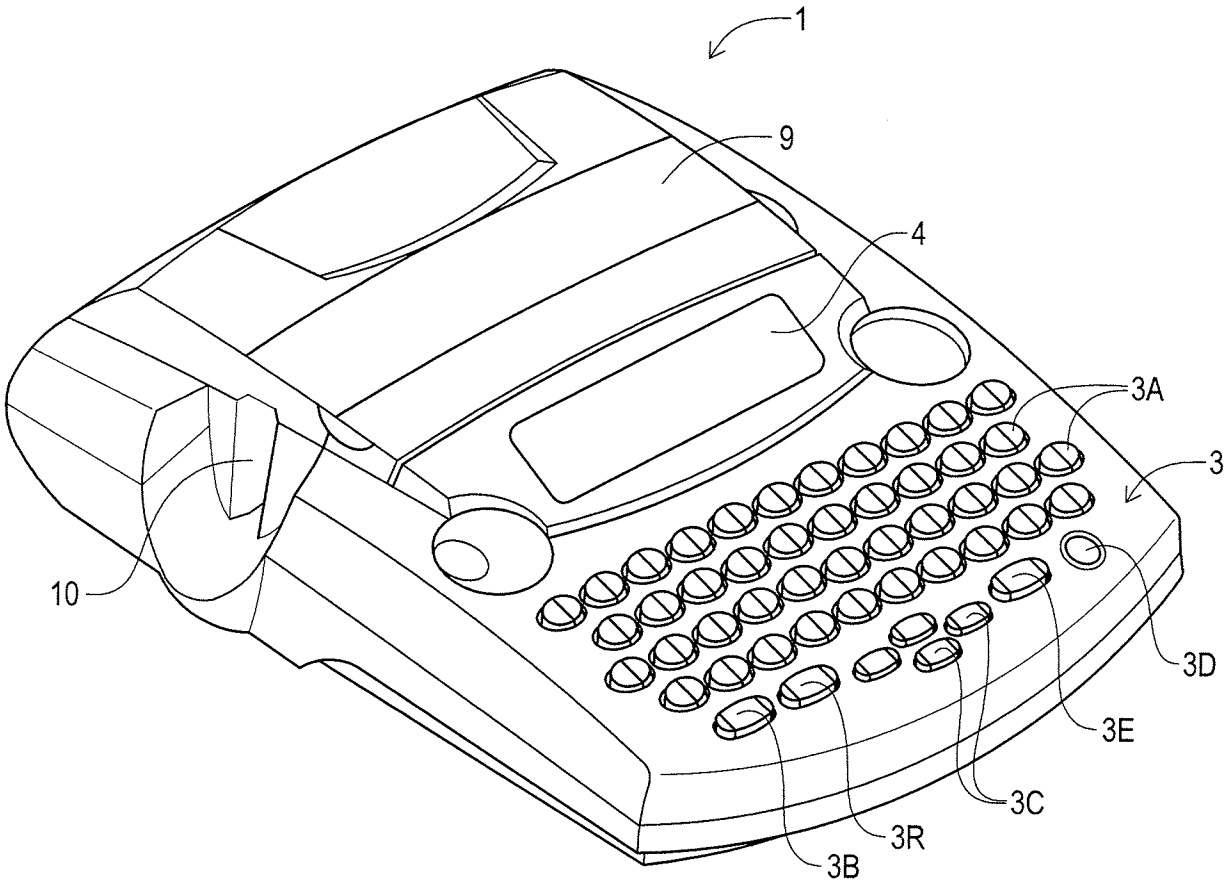
FIG. 4 is a perspective view of a tape printing apparatus that carries out the program of the method for controlling the printing speed of the thermal head.

As shown in FIG. 4, the tape printing apparatus 1 is capable of controlling a printing speed of a thermal head. The tape printing apparatus 1 is a printer for carrying out printing on a tape fed from a tape cassette 5 (refer to FIG. 5) housed inside a cabinet of the tape printing apparatus 1. The tape printing apparatus 1 includes a keyboard 3 and a liquid crystal display 4 on the top of the cabinet. Further, there is arranged a cassette holding portion 8 (refer to FIG. 5) for holding the tape cassette 5. The cassette holding portion 8 is a rectangular shape when seen from top, placed inside the cabinet from a top portion thereof and covered by a housing cover 9. Beneath the keyboard 3, a control board (not shown) constituting a control circuit portion is arranged. A tape ejecting portion 10 for ejecting a printed tape is formed at the left side of the cassette holding portion 8. Further, a connection interface (not shown) is arranged at the right side of the tape printing apparatus 1. The connection interface is used for connecting the tape printing apparatus 1 to an external apparatus (e.g., a personal computer, etc.) in a manner of either wire line connection or wireless connection. Accordingly, the tape printing apparatus 1 is capable of printing out printing data transmitted from an external apparatus.

The keyboard 3 includes plural operation keys such as letter input keys 3A, a print key 3B, cursor keys 3C, a power key 3D, a setting key 3E, a return key 3R, etc. The letter input keys 3A are operated for inputting letters that create texts consisting of document data. The print key 3B is operated for commanding to print out printing data consisting of created texts, etc. The cursor keys 3C are operated for moving a cursor being indicated in the liquid crystal display 4 up, down, left or right. The power key 3D is operated for turning on or off the power of the main body of the tape printing apparatus 1. The setting key 3E is operated for setting various conditions (setting of printing density and the like). The return key 3R is operated for executing a line feeding instruction or various processing and for determining a choice from candidates.

The liquid crystal display 4 is a display device for indicating characters such as letters, etc. in plural lines, i.e., displaying printing data created by the keyboard 3.

Figure 5:
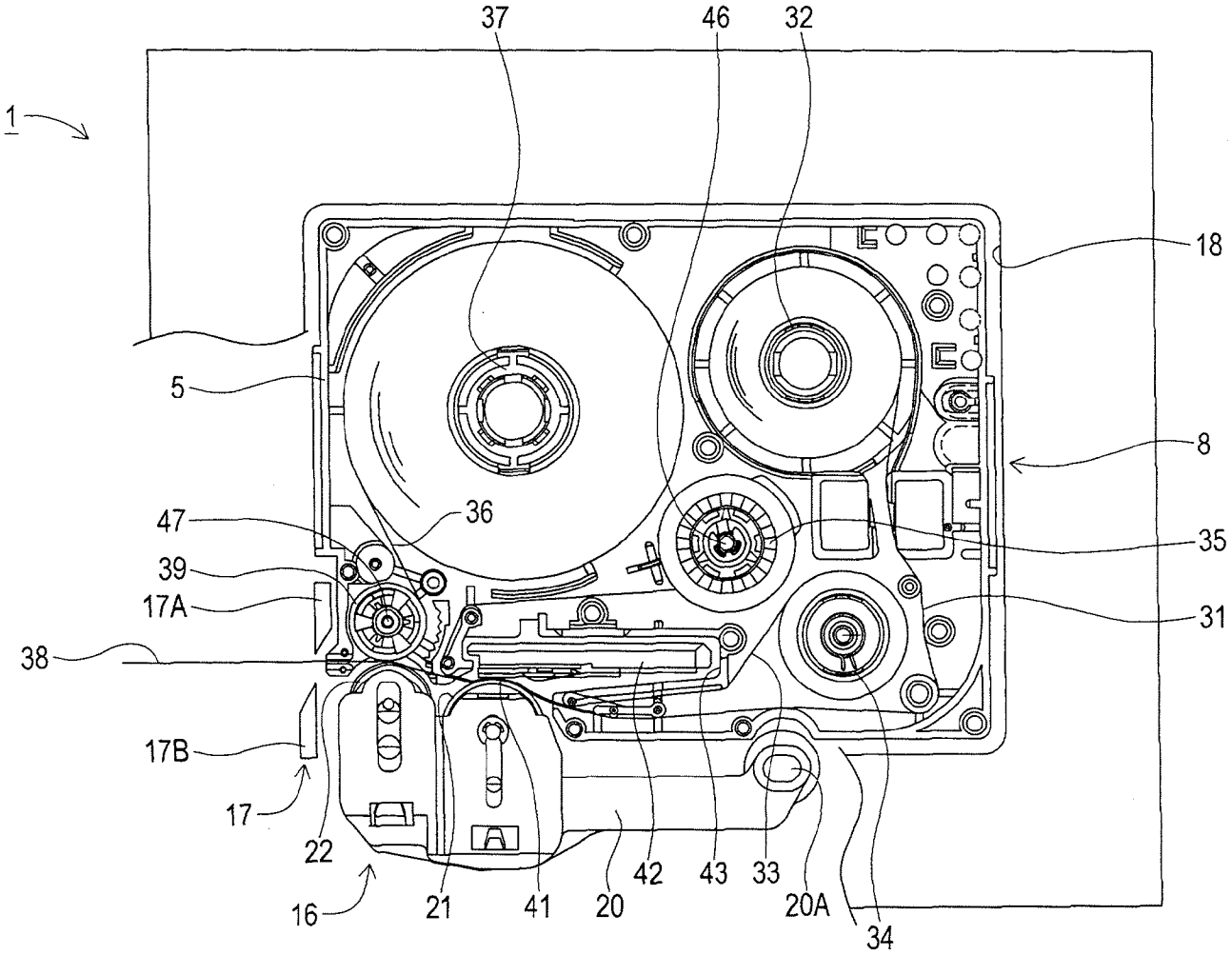
FIG. 5 is a top plan view showing a vicinity of a cassette holding portion of the tape printing apparatus.
Figure 6:
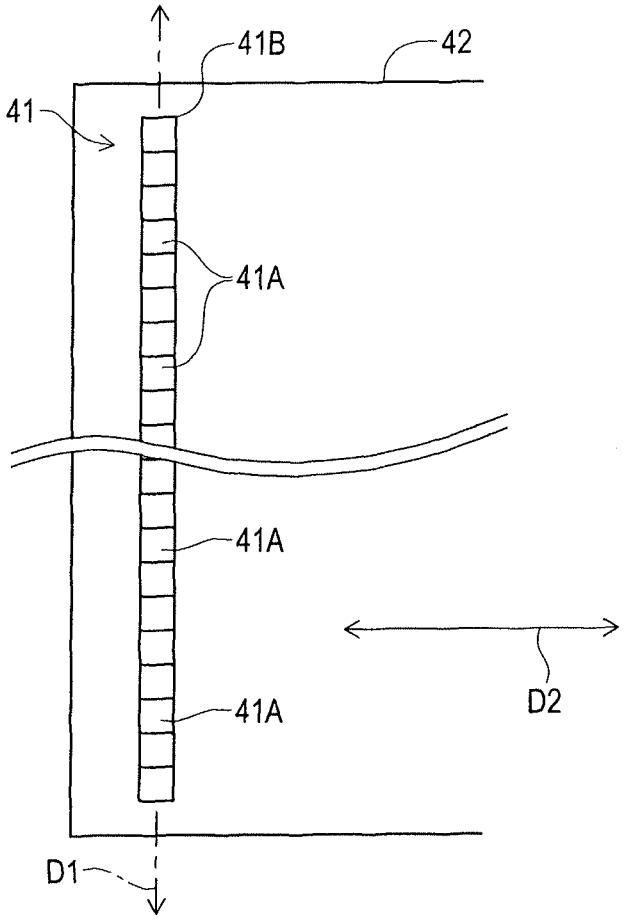
FIG. 6 is an enlarged view of the thermal head of the tape printing apparatus.

As shown in FIG. 5, the tape printing apparatus 1 is configured such that the tape cassette 5 can be replaceably placed in the cassette holding portion 8 arranged inside thereof. Further, inside the tape printing apparatus 1, there are arranged a tape driving and printing mechanism 16 and tape cutting mechanism including a cutter 17. The tape printing apparatus 1 is capable of carrying out printing onto a tape fed from the tape cassette 5 by the tape driving and printing mechanism 16 in accordance with desired printing data. Further, the tape printing apparatus 1 is capable of cutting off a printed part of a tape with the cutter 17 constituting the tape cutting mechanism. The printed part of the tape thus cut off is ejected from the tape ejecting portion 10 formed on the left side of the tape printing apparatus 1.

Inside the tape printing apparatus 1, a cassette holding frame 18 is arranged. As shown in FIG. 5, the tape cassette 5 is replaceably placed into the cassette holding frame 18.

The tape cassette 5 includes a tape spool 32, a ribbon feeding spool 34, a used-ribbon-take-up spool 35, a base-material-sheet feeding spool 37 and a bonding roller 39 in a rotatably-supported manner, inside thereof. A surface tape 31 (corresponding to the above "the printing medium 101") is wound around the tape spool 32. The surface tape 31 is made of a transparent tape such as PET (polyethylene terephthalate) film or the like. An ink ribbon 33 is wound around the ribbon feeding spool 34. On the ink ribbon 33, there is applied ink that melts or sublimes when heated so as to form an ink layer. A part of the ink ribbon 33 that has been used for printing is taken up in the used-ribbon-take-up spool 35. A double tape 36 is wound around the base-material-sheet feeding spool 37. The double tape 36 is configured so as to bond the surface tape 31 and a release tape to one side and the other side of a double-sided adhesive tape wherein the double-sided adhesive tape includes adhesive agent layers at both sides thereof with width the same as width of the surface tape 31. The double tape 36 is wound around the base-material-sheet feeding spool 37 so that the release tape is located outside. The bonding roller 39 is used for bonding the double tape 36 and the surface tape 31 together.

As shown in FIG. 5, in the cassette holding frame 18, an arm 20 is arranged around a shaft 20A in a pivotal manner. A platen roller 21 and a conveying roller 22 are rotatably supported at the front edge of the arm 20. Both the platen roller 21 and the conveying roller 22 employ a flexible member made of rubber or the like for their surfaces. When the arm 20 fully swings clockwise, the platen roller 21 presses the surface tape 31 and the ink ribbon 33 against a thermal head 41 to be described later. At the same time, the conveying roller 22 presses the surface tape 31 and the double tape 36 against the bonding roller 39.

A plate 42 is arranged upright inside the cassette holding frame 18.

The plate 42 includes the thermal head 41 at its side surface facing the platen roller 21. The thermal head 41 consists of a line head 41B or the like made up of a plurality (here, 128 pieces) of heater elements 41A aligned in the width direction of the surface tape 31 and the double tape 36. In this connection, the direction that the heater elements 41A are aligned is the "main scanning direction D1 for the thermal head 41". Further, a direction that the surface tape 31 and the ink ribbon 33 moves passing the thermal head 41 is the "sub scanning direction D2 for the thermal head 41". The "sub scanning direction D2" is orthogonal to the "main scanning direction D1. Reverting to FIG. 5, when the tape cassette 5 is placed in a predetermined position, the plate 42 is fitted in a concave portion 43 of the tape cassette 5.

Further, as shown in FIG. 5, a ribbon-take-up roller 46 and a bonding-roller driving roller 47 are arranged upright inside the cassette holding frame 18. When the tape cassette 5 is placed in the predetermined position, the ribbon-take-up roller 46 and the bonding-roller driving roller 47 are inserted in the used-ribbon-take-up spool 35 and the bonding roller 39 of the tape cassette 5, respectively.

Figure 7:
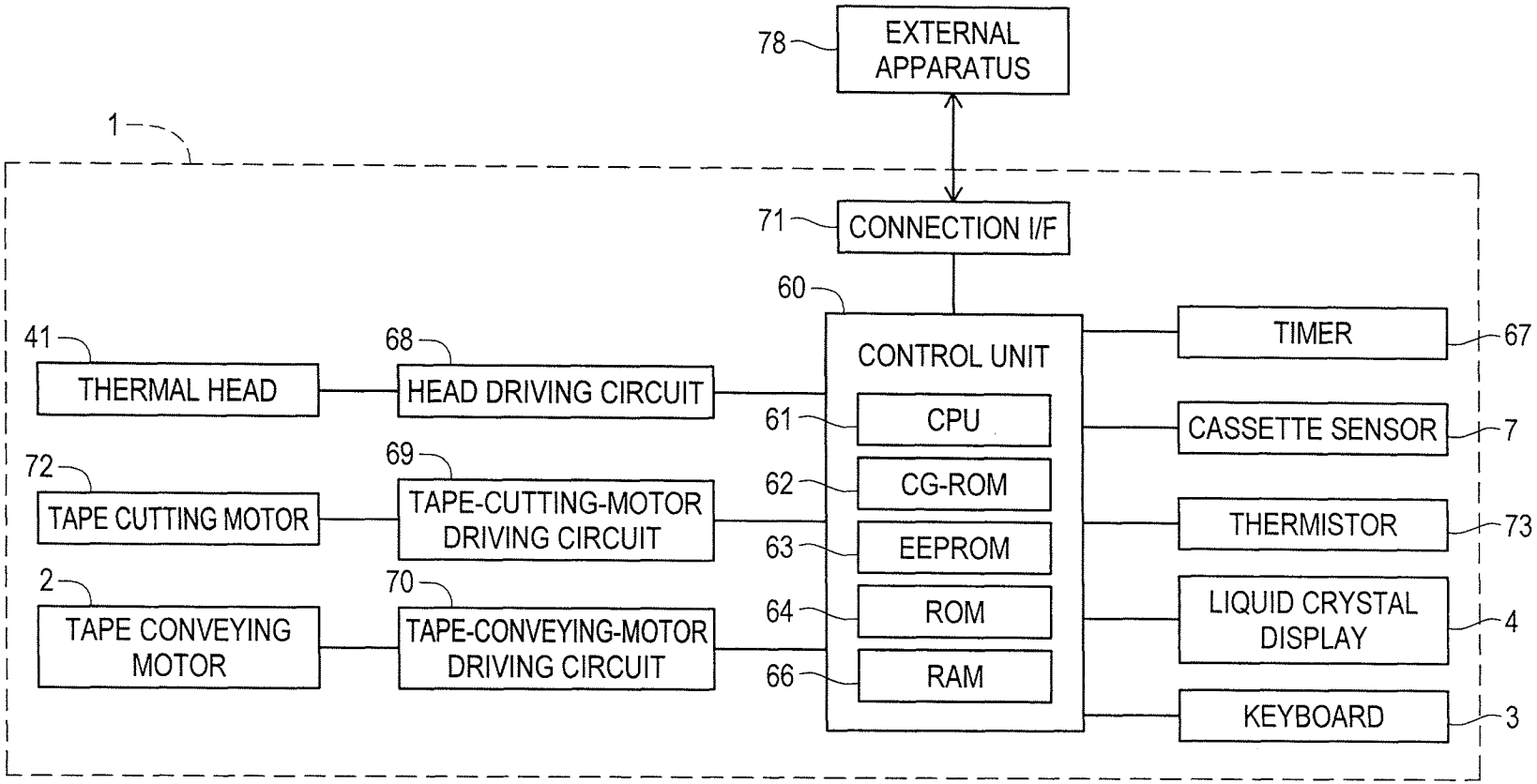
FIG. 7 is a block diagram illustrating a control system of the tape printing apparatus.

In the cassette holding frame 18, there is arranged a tape conveying motor 2 (refer to FIG. 7). Driving force of the tape conveying motor 2 is transmitted to the platen roller 21, the conveying roller 22, the ribbon-take-up roller 46 and the bonding-roller driving roller 47, etc. via series of gears arranged along the cassette holding frame 18. Accordingly, when rotation of an output shaft of the tape conveying motor 2 is started with supply of power to the tape conveying motor 2, rotation of the used-ribbon-take-up spool 35, the bonding roller 39, the platen roller 21 and the conveying roller 22 is started in conjunction with the operation of the tape conveying motor 2. Thereby, the surface tape 31, the ink ribbon 33 and the double tape 36 in the tape cassette 5 are loosed out from the tape spool 32, the ribbon feeding spool 34 and the base-material-sheet feeding spool 37, respectively, and are conveyed in a downstream direction (toward the tape ejecting portion 10 and the used-ribbon-take-up spool 35).

Thereafter, the surface tape 31 and the ink ribbon 33 are bonded together and go through a path between the platen roller 21 and the thermal head 41 in a superimposed state. Accordingly, in the tape printing apparatus 1 of the embodiment, the surface tape 31 and the ink ribbon 33 are conveyed with being pressed by the platen roller 21 and the thermal head 41. The significant number of the heater elements 41A aligned on the thermal head 41 are selectively and intermittently energized (in a manner of pulse application) by a control unit 60 (refer to FIG. 7) in accordance with printing data and a printing control program to be described later.

Each heater element 41A gets heated by power supply and melts or sublimes ink applied on the ink ribbon 33. Therefore, ink in the ink layer on the ink ribbon 33 is transferred onto the surface tape 31 in a unit of dots.

Consequently, a printing-data-based dot image desired by a user is formed on the surface tape 31 as mirror image.

After passing through the thermal head 41, the ink ribbon 33 is taken up by the ribbon-take-up roller 46. On the other hand, the surface tape 31 is superimposed onto the double tape 36 and goes through a path between the conveying roller 22 and the bonding roller 39 in a superimposed state. At the same time, the surface tape 31 and the double tape 36 are pressed against each other by the conveying roller 22 and the boding roller 39 so as to form a laminated tape 38. Of the laminated tape 38, a printed-side surface of the surface tape 31 furnished with dot printing and the double tape 36 are firmly superimposed together. Accordingly, a user can see a normal image of the printed image from the reversed side for the printed-side surface of the surface tape 31 (i.e., the top side of the laminated tape 38).

Thereafter, the laminated tape 38 is conveyed further downstream with respect to the conveying roller 22 to reach the tape cutting mechanism including the cutter 17. The tape cutting mechanism consists of the cutter 17 and the tape cutting motor 72 (refer to FIG. 7). The cutter 17 includes a fixed blade 17A and a rotary blade 17B. More specifically, the cutter 17 is a scissors-like cutter that cuts off an object to be cut off by rotating the rotary blade 17B against the fixed blade 17A. The rotary blade 17B is arranged so as to be able to rotate back and forth with reference to a shaft thereof with the aid of the tape cutting motor 72. Accordingly, the laminated tape 38 is cut off with the fixed blade 17*a* and the rotary blade 17B along operation of the tape cutting motor 72. The laminated tape 38 thus cut off is ejected outside of the tape printing apparatus 1 via the tape ejecting portion 10. By peeling off the release paper from the double tape 36 and exposing the adhesive agent layer, the laminated tape 38 can be used as adhesive label that can be adhered to an arbitrary place.

[3. Control Configuration of the Tape Printing Apparatus]

Next, the control configuration of the tape printing apparatus 1 will be described referring to drawings. As shown in FIG. 7, inside the tape printing apparatus 1, there is arranged a control board (not shown) on which a control unit 60, a timer 67, a head driving circuit 68, a tape-cutting-motor driving circuit 69 and a tape-conveying-motor driving circuit 70 are arranged.

The control unit 60 consists of a CPU 61, a CG-ROM 62, an EEPROM 63, a ROM 64 and a RAM 66. Furthermore, the control unit 60 is connected to the timer 67, the head driving circuit 68, the tape-cutting-motor driving circuit 69 and the tape-conveying-motor driving circuit 70. The control unit 60 is also connected to the liquid crystal display 4, a cassette sensor 7, a thermistor 73, the keyboard 3 and a connection interface 71. The CPU 61 is a central processing unit that plays a primary role for various system controls of the tape printing apparatus 1. Accordingly, the CPU 61 controls various peripheral devices such as the liquid crystal display 4 etc. in accordance with input signals from the keyboard 3 as well as various control programs to be described later.

The CG-ROM 62 is a character generator memory wherein image data of to-be-printed letters and signs are associated with code data and stored in dot patterns. The EEPROM 63 is a non-volatile memory that allows data write for storing therein and deletion of stored data therefrom. The EEPROM 63 stores data that indicates user setting etc. of the tape printing apparatus 1. The ROM 64 stores various control programs and various data for the tape printing apparatus 1. Accordingly, control programs and data tables to be described later are stored in the ROM 64.

The RAM 66 is a storing device for temporarily storing a processing result of the CPU 61 etc. The RAM 66 also stores printing data created with inputs by means of the keyboard 3, printing data taken therein from external apparatus 78 via the connection interface 71. The timer 67 is a time-measuring device that measures passage of predetermined length of time for executing control of the tape printing apparatus 1. More specifically, the timer 67 is referred, for instance, for detecting start and termination of an energization (pulse application) period for a heater element 41A of the thermal head 41. Further, the thermistor 73 is a sensor that detects temperature in vicinity of the thermal head 41 and attached on the thermal head 41.

The head driving circuit 68 is a circuit that serves to supply a driving signal to the thermal head 41 for controlling drive state of the thermal head 41 along a control program to be described later. In this connection, the head driving circuit 68 controls to energize and de-energize each of the heater elements 41A based on a signal (strobe (STB) signal) associated with a strobe number assigned to each heater element 41A for comprehensively controlling heating manner of the thermal head 41. The tape-cutting-motor driving circuit 69 is a circuit that serves to supply a driving signal to the tape cutting motor 72 based on the control signal from the CPU 61 for controlling operation of the tape cutting motor 72. Further, the tape-conveying motor driving circuit 70 is a control circuit that serves to supply a driving signal to a tape conveying motor 2 along the control program to be described later for controlling operation of the tape conveying motor 2.

[4. Control Operation of the Tape Printing Apparatus]

Next, printing speed control of the thermal head 41 in the tape printing apparatus 1 will be described. The control program shown in the flow chart of FIG. 2 is a program for controlling the printing speed of the thermal head 41 in the tape printing apparatus 1, stored in the ROM 64 or the like and executed by the CPU 61.

Figure 2:
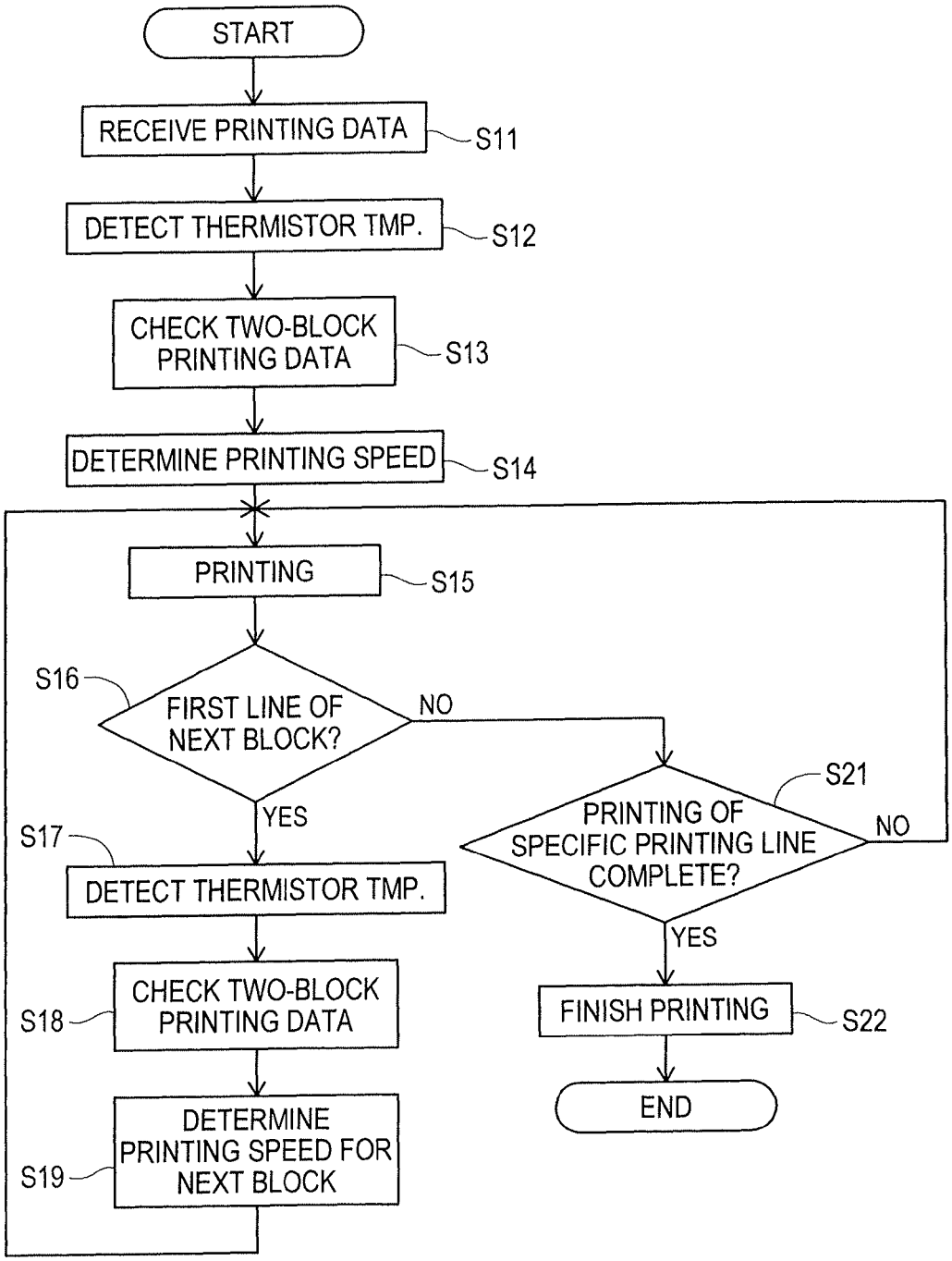
FIG. 2 is a flowchart of a program of the method for controlling the printing speed of the thermal head.

As illustrated in FIG. 2, in the printing speed control of the thermal head 41 in the tape printing apparatus 1, first, a set of printing data is received at S11. Here, the set of printing data is retrieved from an external apparatus 78 (for instance, a personal computer or the like) through the connection interface 71 and is stored in the RAM 66. Incidentally, the set of printing data generated by the input from the keyboard 3 may be stored in the RAM 66. Thereafter, the control program proceeds to S12.

At S12, the thermistor temperature detection is carried out. Here, the temperature detected at the thermistor 73 is retrieved based on a detection signal from the thermistor 73. Thereafter, the control program proceeds to S13.

At S13, two-block printing data confirmation is carried out. Here, the processing is described referring to the embodiment of FIG. 1. There is obtained a speed determination block A containing 124 printing lines and being the first block of the set of printing data. Then, there is obtained a speed determination block B containing 124 printing lines and following the speed determination block A. Further, the total number of heater elements 41A to be driven with respect to the speed determination block A is calculated for each printing line of the 124 printing lines contained, and the maximum number from among the total numbers calculated is obtained as the maximum number of on-dots for the speed determination block A. Similarly, the maximum number of on-dots with regard to the speed determination block B is obtained. Thereafter, the control program proceeds to S14.

At S14, printing speed determination is carried out. In the processing, the detected temperature of the thermistor 73 obtained at S12, the maximum number of on-dots calculated at S13, and data tables depicted in FIG. 3A and FIG. 3B are referenced, so as to determine the printing speeds of the thermal head 41 for the two blocks having been subject to the printing data confirmation at S13.

To be more specific, in the processing of S14, a temperature rank is first determined, referring to the detected temperature of the thermistor 73 obtained at S12 and the temperature rank determination table depicted in FIG. 3B. For instance, if the detected temperature of the thermistor 73 obtained at S12 is 30 degrees Celsius, the temperature rank is determined to be "6" according to the temperature rank determination table in FIG. 3B.

Next, in this processing, the determined temperature rank, the maximum number of on-dots calculated at S13 and the printing speed determination table shown in FIG. 3A are referenced to determine the printing speed of the thermal head 41 for one block where the maximum number of on-dots is currently obtained.

Here is explained the detail of the processing when the temperature rank is determined to be "6". If the maximum number of on-dots calculated at S13 is "128 through 113", 15 mm/sec is selected as the printing speed of the thermal head 41 for the one block where the maximum number of on-dots is currently obtained. If the maximum number of on-dots calculated at S13 is "112 through 97" or "96 through 81", 20 mm/sec is selected as the printing speed of the thermal head 41 for the one block where the maximum number of on-dots is currently obtained. If the maximum number of on-dots calculated at S13 is "80 through 65" or "64 or less", 30 mm/sec is selected as the printing speed of the thermal head 41 for the one block where the maximum number of on-dots is currently obtained.

The processing is further described taking the embodiment of FIG. 1 as an example. First, there is obtained the printing speed of the thermal head 41 for the speed determination block A, the first block in the set of printing data. Here, at the speed determination block A, the maximum number of on-dots is "0", so that 30 mm/sec is selected as the printing speed of the thermal head 41. Accordingly, referring to the data tables depicted in FIG. 3A and FIG. 3B, one of "1" through "11" can be selected as the temperature rank, and the detected temperature of the thermistor 73 obtained at S12 is 5 degrees Celsius or higher. Next, there is obtained the printing speed of the thermal head 41 for the speed determination block B following the speed determination block A. Similarly, at the speed determination block B, the maximum number of on-dots is "0", so that 30 mm/sec is selected as the printing speed of the thermal head 41. Accordingly, referring to the data tables in FIG. 3A and FIG. 3B, one of "1" through "11" is selected as the temperature rank, and the detected temperature of the thermistor 73 obtained at S12 is 5 degrees Celsius or higher.

Incidentally, the data tables depicted in FIG. 3A and FIG. 3B are previously set such that, the smaller the maximum number of on-dots is, the slower the printing speed of the thermal head 41 to be determined in the processing becomes, and further, the higher the temperature detected at the thermistor 73 is, the faster the printing speed of the thermal head 41 to be determined in the processing becomes. The printing speed determination table depicted in FIG. 3A is a table for battery operation, but the ROM 64 may store an additionally-prepared table for commercial power source operation.

Reverting to FIG. 2, the control program proceeds to S15 to carry out printing. Here, with regard to the former block of the two consecutive blocks in the set of printing data having been subject to the printing data confirmation of S13 or of the later-described most recent S18 if a series of steps S15 to S19 has been previously carried out, one printing line is printed at the printing speed of the thermal head 41 determined at S14 or later-described S19. The processing is described taking the embodiment of FIG. 1 as an example. In a target block (one of the speed determination blocks A through J) having been subject to the printing data confirmation of S13 or of the most recent S18, one printing line is printed from among the 124 printing lines forming a piece of printing data. However, as described later, if the printing data confirmation is carried out again only with regard to the speed determination block K which is the last block in the set of printing data at the most recent S18, one printing line is printed in the speed determination block K containing 124 printing lines or less.

At this time, if the printing speed of the thermal head 41 for the target block including the one printing line to be printed is faster than the printing speed of the thermal head 41 for a block immediately before the target block, an acceleration area is provided in which the printing speed of the thermal head 41 is accelerated in the beginning of the target block including the one printing line to be printed. The processing is described taking the embodiment of FIG. 1 as an example. The printing speed (30 mm/sec) of the thermal head 41 for the speed determination block E is faster than the printing speed (20 mm/sec) of the thermal head 41 for the speed determination block D immediately before the speed determination block E. Accordingly, if the target block including the one printing line to be printed is the speed determination block E, an acceleration area containing 12 printing lines is provided in the beginning of the speed determination block E, and the printing speed of the thermal head 41 accelerates from 20 mm/sec to 30 mm/sec in the acceleration area.

Further, the printing speed of the thermal head 41 of the target block including the one printing line to be printed is faster than the printing speed of the thermal head 41 of a block immediately following the target block, a deceleration area is provided in which the printing speed of the thermal head 41 is decelerated, in the end of the target block including the one printing line to be printed. The processing is described taking the embodiment of FIG. 1 as an example. The printing speed (30 mm/sec) of the thermal head of the speed determination block E is faster than the printing speed (15 mm/sec) of the thermal head 41 of the speed determination block F immediately after the speed determination block E. Accordingly, if the target block including the one printing line to be printed is the speed determination block E, a deceleration area containing 12 printing lines is provided in the end of the speed determination block E, and the printing speed of the thermal head 41 is decelerated from 30 mm/sec to 15 mm/sec at the deceleration area.

Incidentally, if the target block including the one printing line to be printed is the speed determination block A, as the speed determination block A is the first block in the set of printing data, an acceleration area containing 12 printing lines is provided at the beginning of the speed determination block A including the one printing line to be printed, and the printing speed of the thermal head 41 is accelerated from 0 mm/sec to 30 mm/sec in the acceleration area.

Meanwhile, if the target block including the one printing line to be printed is the speed determination block K, as the speed determination block K is the last block in the set of printing data, a deceleration area containing 12 printing lines is provided in the end of the speed determination block K including the one printing line to be printed, and the printing speed of the thermal head 41 is decelerated from 15 mm/sec to 0 mm/sec at the deceleration area.

Thereafter, the control program proceeds to S16. At S16, it is determined whether a next printing line is the first line of the next block. In this determination, if the next printing line following the one printing line printed at S15 is the first printing line of the latter block of the two consecutive blocks having been subject to the printing data confirmation of S13 or of the most recent S18, the next printing line is determined as being the first line of the next block, and otherwise, it is determined as not being the first line of the next block.

The processing is described taking the embodiment of FIG. 1 as an example. Here is discussed a case where the one printing line printed at S15 is included in the speed determination block A having been subject to the printing data confirmation of S13. If the next printing line following the one printing line printed at S15 is the first printing line included in the speed determination block B of the latter block of the two consecutive speed determination blocks A, B having been subject to the printing data confirmation of S13, the next printing line is determined as being the first line of the next block. If the next printing line is a printing line included in the speed determination block A positioned first in the set of printing data, the next printing line is determined as not being the first line of the next block.

Similarly, here is discussed a case where the one printing line printed at S15 is included in the speed determination block J having been subject to the printing data confirmation of the most recent S18. If the next printing line following the one printing line printed at S15 above is the first printing line included in the speed determination block K, the latter block of the two consecutive speed determination blocks J, K having been subject to the printing data confirmation of the most recent S18, the next printing line is determined as being the first line of the next block. If the next printing line is a printing line included in the speed determination block J having been subject to the printing data confirmation of the most recent S18, the next printing line is determined as not being the first line of the next block.

However, in a case where the one printing line printed at S15 is included in the speed determination block K, it is always determined as not being the first line of the next block as the speed determination block K is the last block in the set of printing data.

Here, if it is determined that the next printing line is the first line in the next block (S16: YES), the control program proceeds to S17. At S17, the thermistor temperature detection is carried out. Here, the temperature detected at the thermistor 73 is obtained based on the detection signal from the thermistor 73. Thereafter, the control program proceeds to S18.

At S18, two-block printing data confirmation is carried out. Here, in the set of printing data received at S11, there are obtained the latter block of the two consecutive blocks having been subject to the printing data confirmation of S13 or of the most recent S18 if a series of steps S15 to S19 have been previously carried out, and the next block immediately following the latter block. Further, the total number of heater elements 41A to be driven is calculated for each printing line of the 124 printing lines contained, with respect to the obtained blocks. Then the maximum number from among the calculated total numbers is obtained as the maximum number of on-dots for each of the obtained blocks.

The processing is now described taking the embodiment of FIG. 1 as an example. The speed determination block B is the latter of the two consecutive speed determination blocks A, B having been subject to the printing data confirmation of S13, with respect to the set of printing data. Accordingly, here are obtained the speed determination block B and a speed determination block C immediately following the speed determination block B with respect to the set of printing data. Further, the total number of heater elements 41A to be driven is calculated for each printing line of the 124 printing lines contained, with respect to the speed determination block C. Then the maximum number ("0" in the embodiment in FIG. 1) from among the calculated total numbers is obtained as the maximum number of on-dots for the speed determination block C. Similarly, with regard to the speed determination block B, the maximum number of on-dots is obtained. However, the maximum number of on-dots of the speed determination block B may be as obtained again here at the current S18; however, the number obtained at S13 may be used as well.

Meanwhile, if speed determination blocks I, J are the two consecutive blocks having been subject to the printing data confirmation of the most recent S18, the speed determination block J is the latter of the two consecutive blocks with respect to the set of the printing data. Accordingly, the speed determination block J and the speed determination block K immediately following the speed determination block J in the set of printing data can be obtained. Further, the total number of heater elements 41A to be driven is calculated for each printing line of the 124 or less printing lines contained, with respect to the obtained speed determination block K. Then the maximum number ("128" in the embodiment in FIG. 1) from among the calculated total numbers is obtained as the maximum number of on-dots for the speed determination block K. However, the maximum number of on-dots of the speed determination block J may be as obtained again here, at the current S18; however, the number obtained at the most recent S18 may be used as well.

However, if speed determination blocks J, K are the two consecutive blocks having been subject to the printing data confirmation of the most recent S18, there is again confirmed the maximum number of on-dots obtained at the most recent S18 with respect to the speed determination block K which is the last block in the set of printing data. However, the maximum number of on-dots in the speed determination block K may be calculated again at the current S18.

Thereafter, the control program proceeds to S19. At S19, the printing speed determination for the next block is carried out. There, using the temperature detected at the thermistor 73 and obtained at S17, the maximum number of on-dots calculated at S18 and the data tables depicted in FIG. 3A and FIG. 3B, the printing speed of the thermal head 41 at a block having currently calculated or confirmed the maximum number of on-dots at S18 is determined. The processing is the same as in S14 described above.

The processing is described taking the embodiment of FIG. 1 as an example. Here is obtained the printing speed of one of the speed determination blocks C through K each containing 124 printing lines or less. Incidentally, the block where the maximum number of on-dots currently obtained at S18 is the speed determination block C, the maximum number of on-dots is "80", and the printing speed of the thermal head 41 is determined as 20 mm/sec. Accordingly, referring to the data table FIG. 3A and FIG. 3B, the temperature rank is determined to be one of "1" through "3", and the detected temperature at the thermistor 73 obtained at S17 is 5 degrees Celsius or higher and below 20 degrees Celsius. Meanwhile, if the block for which the maximum number of on-dots has been confirmed again at S18 is the speed determination block K, the maximum number of on-dots is "128", and the printing speed of the thermal head 41 is determined to be 15 mm/sec. Accordingly, referring to the data tables depicted in FIG. 3A and FIG. 3B, the temperature rank is one of "1" through "6", and the detected temperature at the thermistor 73 obtained at S17 is 5 degrees Celsius or higher and below 35 degrees Celsius.

Thereafter, the control program returns to S15, and again proceeds to S16 to repeat the control program starting from S15.

At this S16, if it is determined that the printing line is not the first line of the next block (S16: NO), the control program proceeds to S21. At S21, there is determined whether printing of a specific printing line has been complete. In this determination, if there exists the next printing line following the one printing line printed at S15, it is determined that the printing of the specific printing line has not been complete. Conversely, if there exists no next printing line following the one printing line printed at S15, it is determined that the printing of the specific printing line has been complete.

The determination is described taking the embodiment of FIG. 1 as an example. If the next printing line following the one printing line printed at S15 is one of printing lines included in the speed determination block A through K, it is determined that printing of a specific printing line has not been complete. Conversely, if there exists no next printing line following the one printing line printed at S15, in other words, if the one printing line printed at S15 is the last printing line in the speed determination block K, it is determined that the printing of the specific printing line has been complete.

Here, if the printing of the specific printing line is not complete (S21: NO), the control program returns to S15 and the control program is repeated from the S15. Conversely, if the printing of the specific printing line is complete (S21: YES), the control program proceeds to S22. At S22, the printing operation is finished. Thus, the control of the printing speed of the thermal head 41 in the tape printing apparatus 1 comes to an end.

[5. Summary]

As has been discussed above, the control method of the printing speed of the thermal head 41 according to the embodiment is for controlling the printing speed of the thermal head 41 having 128 heater elements 41A arranged in line. Here, if the arrangement direction of the 128 heater elements 41 is defined as the main scanning direction D1 of the thermal head 41, the direction orthogonal to the main scanning direction D1 is defined as the sub scanning direction D2. The speed determination blocks A through K are obtained by dividing the set of printing data shown on the printing medium 101 (S13, S18). The speed determination blocks A through K contains more than one printing line aligned in the main scanning direction D1 in the sub scanning direction D2.

In this case, as in the embodiment in FIG. 1, the set of printing data shown on the printing medium 101 is divided into the speed determination blocks A through K, and a block including 124 printing lines is regarded as a unit block. The number of dots of the heater elements 41A to be driven is obtained for each printing line, as the number of on-dots. The maximum number of on-dots is the maximum number from among the numbers of on-dots in a speed determination block. The maximum number of on-dots is calculated for each of the speed determination blocks A through K.

However, the speed determination block K being the last block in the set of printing data shown on the printing medium 101 may be an "odd block" containing less than 124 printing lines.

Referring to the data table in FIG. 3A, the printing speed of the thermal head 41 for one speed determination block is set to be slower than the printing speed of the thermal head 41 of another speed determination block where the maximum number of on-dots is smaller than the maximum number of on-dots for the one speed determination block, so as to variably control the printing speed of the thermal head 41 for each of the speed determination blocks A through K (S14, S15, S19).

Accordingly, in the method for controlling the printing speed of the thermal head 41 directed to the embodiment, as the printing speed of the thermal head 41 can be made variable at each of the speed determination blocks A through K containing 124 or less printing lines obtained by dividing the set of printing data in the sub scanning direction D2 of the thermal head 41, the printing speed of the thermal head 41 is not changed at each printing line in the sub scanning direction D2 of the thermal head 41. That is, the printing speed of the thermal head 41 is changed at each of the speed determination blocks A through K containing 124 or less printing lines in the sub scanning direction D2 of the thermal head 41. Accordingly, the printing speed of the thermal head 41 can be changed with an appropriate frequency, so that the high speed printing can be realized without increasing the current capacity of the adaptor and without adversely affecting the print quality.

Thus, as the necessity of increasing the current capacity of the adaptor is eliminated when realizing the high speed printing, cost reduction can be achieved.

Further, in the method for controlling the printing speed of the thermal head 41 directed to the embodiment, the printing speed of the thermal head 41 for each of the speed determination blocks A through K is set faster in a case where a lower temperature is detected at the thermistor 73, than in a case of a higher temperature, referring to the data table of FIG. 3B.

Thus, through utilizing the temperature in the vicinity of the thermal head 41, energy efficiency can be improved and the high speed printing can be realized without increasing the current capacity of the adaptor.

Further, in the method for controlling the printing speed of the thermal head 41 directed to the embodiment, a constant-acceleration-deceleration phase consisting of 12 printing lines is provided for the speed determination blocks A through K, at least at the beginning and the end thereof, in the sub scanning direction D2 of the thermal head 41. In the constant-acceleration-deceleration phase, the printing speed of the thermal head 41 is constant, accelerated or decelerated. Other than the constant-acceleration-deceleration phase, a constant-speed phase is provided for the speed determination blocks A through K. In the constant-speed phase, the printing speed of the thermal head 41 is constant at a speed determined at S14 or S19.

This operation will be discussed in more detail taking the speed determination blocks A, B, and E as representative examples. With regard to the speed determination block A, it can be said that, a constant-acceleration-deceleration phase is provided at the beginning thereof, which is an acceleration area consisting of 12 printing lines where the printing speed of the thermal head 41 is accelerated, and at the end thereof, a constant-acceleration-deceleration phase consisting of 12 printing lines is provided where the printing speed of the thermal head 41 is constant, and further, between respective constant-acceleration-deceleration phases, there is a constant-speed phase where the printing speed of the thermal head 41 is constant. With regard to the speed determination block B, it can be said that, at the beginning thereof, a constant-acceleration-deceleration phase consisting of 12 printing lines is provided where the printing speed of the thermal head 41 is constant, and at the end thereof, a constant-acceleration-deceleration phase is provided, which is a deceleration area consisting of 12 printing lines where the printing speed of the thermal head 41 is decelerated, and further, between respective constant-acceleration-deceleration phases, there is a constant-speed phase where the printing speed of the thermal head 41 is constant. With regard to the speed determination block E, it can be said that, at the beginning thereof, a constant-acceleration-deceleration phase is provided, which is an acceleration area consisting of 12 printing lines where the printing speed of the thermal head 41 is accelerated, and at the end thereof, a constant-acceleration-deceleration phase is provided, which is a deceleration area consisting of 12 printing lines where the printing speed of the thermal head 41 is decelerated, and further, between respective constant-acceleration-deceleration phases, there is a constant-speed phase where the printing speed of the thermal head 41 is constant.

At each of the speed determination blocks A through K, it can be said that a constant-acceleration-deceleration phase is provided immediately before and immediately after a constant-speed phase in the sub scanning direction D2 of the thermal head 41. Thus, printing length adjustment can be carried out in the constant-speed phase where the printing speed of the thermal head 41 is constant. Accordingly, even if the frequency of the printing speed change of the thermal head 41 is increased, the phase for the printing length adjustment can be sufficiently secured.

At each of the speed determination blocks A through K, if the printing speeds of the thermal head 41 for two consecutive speed determination blocks are different, in the speed determination block with the faster printing speed of the thermal head 41, an acceleration area, or a deceleration area, is provided at the beginning thereof following, or at the end thereof followed by, the speed determination block with a slower printing speed of the thermal head 41 (S15). Accordingly, if, at the beginning of a speed determination block, there is a so-called solid portion where the maximum number of on-dots ("128" in the embodiment of FIG. 1) is the upper limit value, the speed determination block is already in a state with slower printing speed of the thermal head 41 from the beginning, so that the thermal head 41 can appropriately cope with the printing of the so-called solid portion.

[6. Printing Length Adjustment]

As has been discussed above, if the tape conveying motor 2 is a step motor, at each of the speed determination blocks A through K, the printing period correction, or in other words, printing length adjustment can be carried out in a constant speed area other than an acceleration area or a deceleration area. To carry out precise correction of a printing length, the printing length is adjusted by a tape feed in a state where the pulse rate of the tape conveying motor 2 is asynchronous to the printing period.

Figure 8:
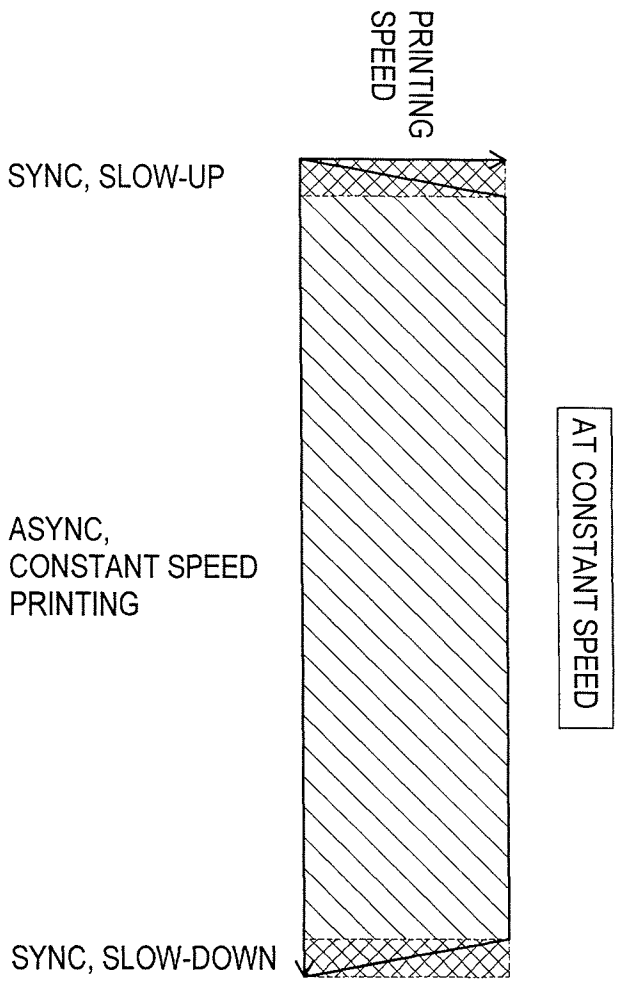
FIG. 8 is a schematic diagram for explaining a printing-length adjustment at constant speed.

For instance, at a constant speed state shown in FIG. 8, the printing period synchronizes with the motor pulse only in the slow-up at the beginning of the printing and in the slow-down in the end of the printing. A comparatively long asynchronous period is provided other than the slow-up and the slow-down, and printing length can be adjusted in the asynchronous period.

Figure 9:
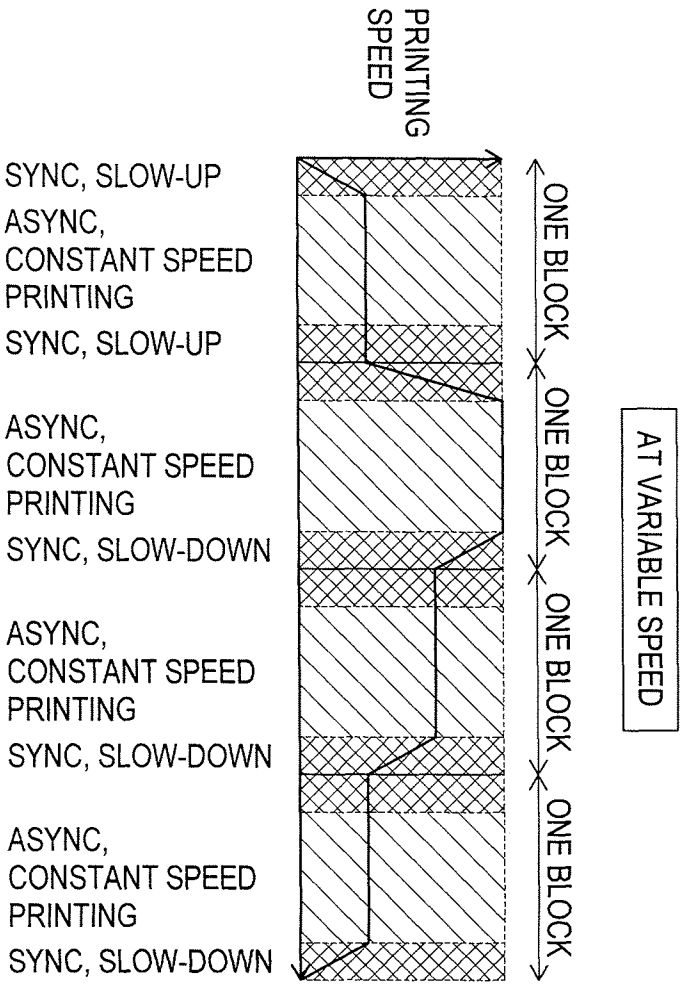
FIG. 9 is a schematic diagram for explaining a printing-length adjustment at variable speed.

In contrast, at a variable speed state shown in FIG. 9, there exist a synchronous period and an asynchronous period alternately within one block, to keep variation of printing length within a certain tolerance; a predetermined proportion of the asynchronous period is required. This is because a comparatively short asynchronous period cannot afford appropriate printing length adjustment.

Figure 10:
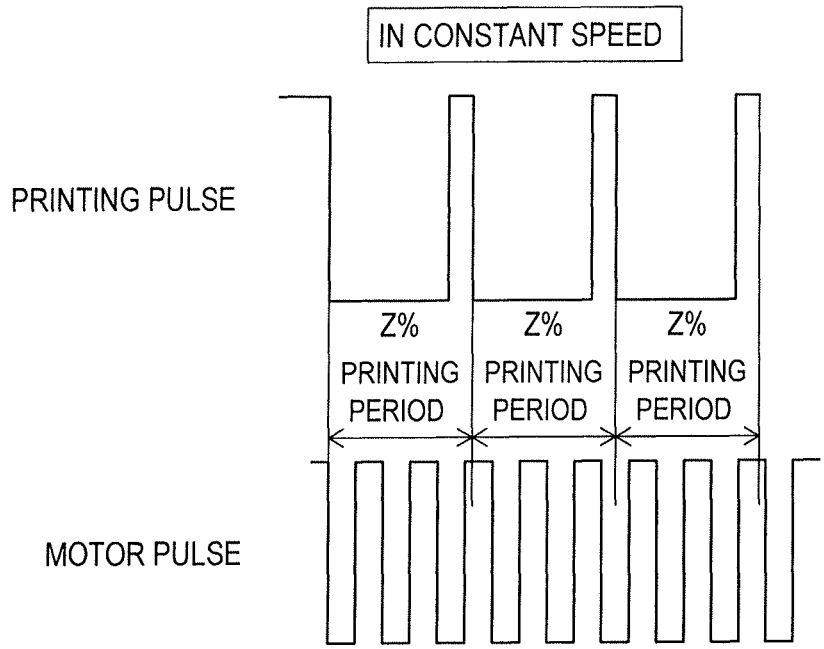
FIG. 10 is a schematic diagram for explaining a printing-length adjustment in a constant speed phase.
Figure 11:
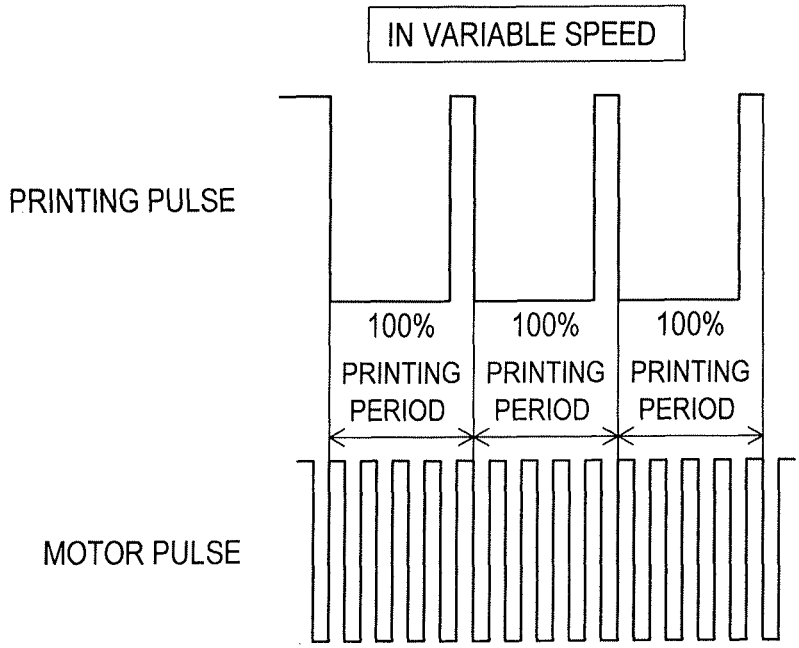
FIG. 11 is a schematic diagram for explaining a printing-length adjustment in a variable speed phase.

Namely, as illustrated in FIG. 10, while the printing speed of the thermal head 41 is constant, the motor pulse of the tape conveying motor 2 and the printing pulse are asynchronous. Consequently, the printing period is adjusted shorter by Z% (Z representing an arbitrary number). Meanwhile, while the printing speed of the thermal head 41 is variable (at slow-up or slow-down), as illustrated in FIG. 11, the motor pulse of the tape conveying motor 2 and the printing pulse are synchronous.

[7. Other]

The present disclosure is not limited to the above-described embodiment, and therefore, modifications can be made thereto without departing from the spirit of the disclosure. For instance, the method for controlling a printing speed of a thermal head 41 according to the disclosure can be applied to a control where the printing speed of the thermal head 41 is constant in at least two consecutive unit blocks, namely, a batch printing. In the embodiment of FIG. 1, it is when the printing speed of the thermal head 41 is constant in the speed determination blocks B through J.

Further, the method for controlling the printing speed of the thermal head 41 according to the disclosure can be employed in a division printing control, realized by a plurality of thermal head 41 aligned in the main scanning direction D1, obtained by dividing a plurality of heater elements 41A arranged in line.

While presently exemplary embodiments have been shown and described, it is to be understood that this disclosure is for the purpose of illustration and that various changes and modifications may be made without departing from the scope of the disclosure as set forth in the appended claims.

What is claimed is:

1. A method for controlling a printing speed of a thermal head having a plurality of heater elements arranged in a line, comprising:

dividing a set of printing data into blocks each comprising one or more printing lines aligned in a main scanning direction parallel to the arranged line of the plurality of heater elements of the thermal head, wherein the dividing is in a sub scanning direction orthogonal to the main scanning direction, and wherein a block including a first predetermined number of printing lines is regarded as a unit block;

calculating the number of the heater elements to be driven for each of printing lines included in a block as the number of on-dots, and comparing the numbers of on-dots for the block to obtain a maximum number of on-dots for the block; and setting a printing speed for one block to be slower than a printing speed for another block with smaller maximum number of on-dots than maximum number of on-dots for the one block, so as to variably control a printing speed of the thermal head by each block.

2. The method for controlling a printing speed of a thermal head directed to claim 1, wherein a block comprises:

a constant-acceleration-deceleration phase comprising a second predetermined number of printing lines, at least at one of a beginning and an end thereof in the sub scanning direction of the thermal head, wherein the printing speed of the thermal head is one of constant, accelerated and decelerated in the constant-acceleration-deceleration phase; and a constant-speed phase consecutive to the constant-acceleration-deceleration phase in the sub scanning direction, wherein the printing speed of the thermal head is constant in the constant-speed phase.

3. The method for controlling a printing speed of a thermal head directed to claim 2, wherein, if different printing speeds of the thermal head are set for two consecutive blocks, of the two consecutive blocks, one block with faster printing speed of the thermal head comprises a constant-acceleration-deceleration phase consecutive to the other block with slower printing speed of the thermal head.

4. The method for controlling a printing speed of a thermal head directed to claim 2, wherein, if the printing data is divided into consecutive unit blocks only:

the printing speed of the thermal head is accelerated in a constant-acceleration-deceleration phase at a beginning of a first unit block of the consecutive unit blocks;

the printing speed of the thermal head is decelerated in a constant-acceleration-deceleration phase at an end of a last unit block of the consecutive unit blocks; and a constant-speed phase is provided in-between, and wherein, if the printing data is divided into consecutive unit blocks and an odd block having odd printing lines which are fewer than the first predetermined number of printing lines following the consecutive unit blocks consecutive in the sub scanning direction of the thermal head:

the printing speed of the thermal head is accelerated in a constant-acceleration-deceleration phase at a beginning of a first unit block of the consecutive unit blocks;

the printing speed of the thermal head is decelerated in a constant-acceleration-deceleration phase at an end of the odd block; and a constant-speed phase is provided in-between.

5. The method for controlling a printing speed of a thermal head directed to claim 1, wherein:

a temperature is measured by a thermistor provided in vicinity of the thermal head; and a printing speed for a block with higher temperature is set to be faster than a printing speed for a block with lower temperature.

* * * * *